US006752604B2

(12) United States Patent
Althouse

(10) Patent No.: US 6,752,604 B2
(45) Date of Patent: Jun. 22, 2004

(54) AUTOMATIC WEAR INDICATOR FOR SLIDING VANE VACUUM AND GAS PRESSURE PUMPS

(76) Inventor: Gerald Donald Althouse, 9804 Airpark Dr., Granbury, TX (US) 76049

( * ) Notice: Subject to any disclaimer, the term of this patent is extended or adjusted under 35 U.S.C. 154(b) by 5 days.

(21) Appl. No.: 10/368,119

(22) Filed: Feb. 15, 2003

(65) Prior Publication Data

US 2003/0202895 A1 Oct. 30, 2003

Related U.S. Application Data

(60) Provisional application No. 60/376,616, filed on Apr. 30, 2002.

(51) Int. Cl.[7] ..... F04C 18/344
(52) U.S. Cl. ..... 418/2
(58) Field of Search ..... 418/2

(56) References Cited

U.S. PATENT DOCUMENTS 3,301,194 A * 1/1967 Brunson ..... 418/2
3,463,384 A * 8/1969 Kilbane ..... 418/2

* cited by examiner

*Primary Examiner*—John J. Vrablik

(57) ABSTRACT

Tracer material, encapsulated within a cavity of the vanes of a sliding vane pump, which is released into the discharge conduit when the vanes reach their predetermined wear limit, acting as a wear indicator.

11 Claims, 5 Drawing Sheets

AUTOMATIC WEAR INDICATOR FOR SLIDING VANE VACUUM AND GAS PRESSURE PUMPS

CROSS-REFERENCE

Provisional Patent & Application No. 60/376,616. Confirmation No.6814 filed Apr. 30, 2002 by applicant Gerald D. Althouse, Granbury, Tex.

BACKGROUND OF INVENTION

This invention pertains to sliding-vane pumps, specifically to a wear indicator for their vanes.

Rotary devices, such as vacuum and pressure pumps, contain components whose wear rate directly influences the reliable, useful operating fife of the entire device. These components can be referred to as critical components. Additionally, continued usage of the device beyond the expected useful life of a critical component often results in catastrophic, sudden and complete, failure of the device and the entire system of which it is a part, without any significant preceding degradation of system performance. This catastrophic failure, without warning, is an especially troublesome characteristic of vacuum and pressure pumps used to drive the gyroscopic flight instruments installed in light aircraft. Malfunction of such instruments while flying in instrument meteorological conditions can lead to loss of aircraft control with disastrous results.

Substantially all of the sliding vane pump failures occur because the vanes become worn to the point where their length of engagement in the rotor slot is too short to provide adequate support. The vane, typically made of graphite, breaks and subsequently causes the remaining vanes to fail. Laboratory testing has been done to determine the maximum wear limit of the vanes beyond which pump failure, within a relatively short time, is a certainty.

Prior relevant developments, designed to determine the state of wear of the vanes, include a removable plug in the pump housing to enable viewing of the rotor and vanes to determine their remaining length. In one of those developments, a plastic go-no-go stick is inserted into the opening. In another development, the aircraft mechanic compares the relative position of two reference holes, one each in the vane and rotor.

Prior developments suffer from a number of disadvantages:

a) The prior developments are approximate, at best, since wear rates of the vanes vary from vane to vane and from pump to pump and during the life of the pump. Laboratory tests show that an error in measurement of vane length of a few thousandths of an inch represents the amount of wear that a typical light aircraft vacuum pump would experience in an entire year.

b) The steps required by both of the above mentioned prior developments are considered to be maintenance by the FAA, and as such, must be conducted by an appropriately certified mechanic. An owner of an aircraft, who is not a certified mechanic, is not permitted to conduct the above mentioned inspection procedures unless he does so while under the supervision of an FAA certified mechanic. This FAA requirement represents an inconvenience and added expense for the aircraft owner.

c) Rather than permitting the pilot to determine if the pump is near its service life limit, at a frequency and time of his choosing, existing methods of determining the state of wear of the vanes are snapshot measurements taken at prescribed intervals.

d) Prior developments require multiple internal inspections to estimate when the pump should be replaced or rebuilt.

SUMMARY

The automatic wear indicator described in this patent application provides for the encapsulation of tracer material within the vanes of sliding vane pumps in such a manner that it is automatically released into the discharge conduit at the precise time that the vane reaches a safe wear limit. Presence therein signals that the pump has reached it's service life.

Accordingly, several objects and advantages of this invention are:

a) to provide a warning of eminent failure b) to provide an automatic indication of vane wear c) to provide an accurate indication of vane wear d) to eliminate the need to employ the services of a certified mechanic e) to permit the pilot to determine if the vanes have reached their service limit f) to provide for automatic switching on of annunciators and other devices g) to eliminate the need to disassemble or remove any components of the pump for internal inspection.

DRAWING FIGURES

REFERENCE NUMERALS IN DRAWINGS

Figure 1:
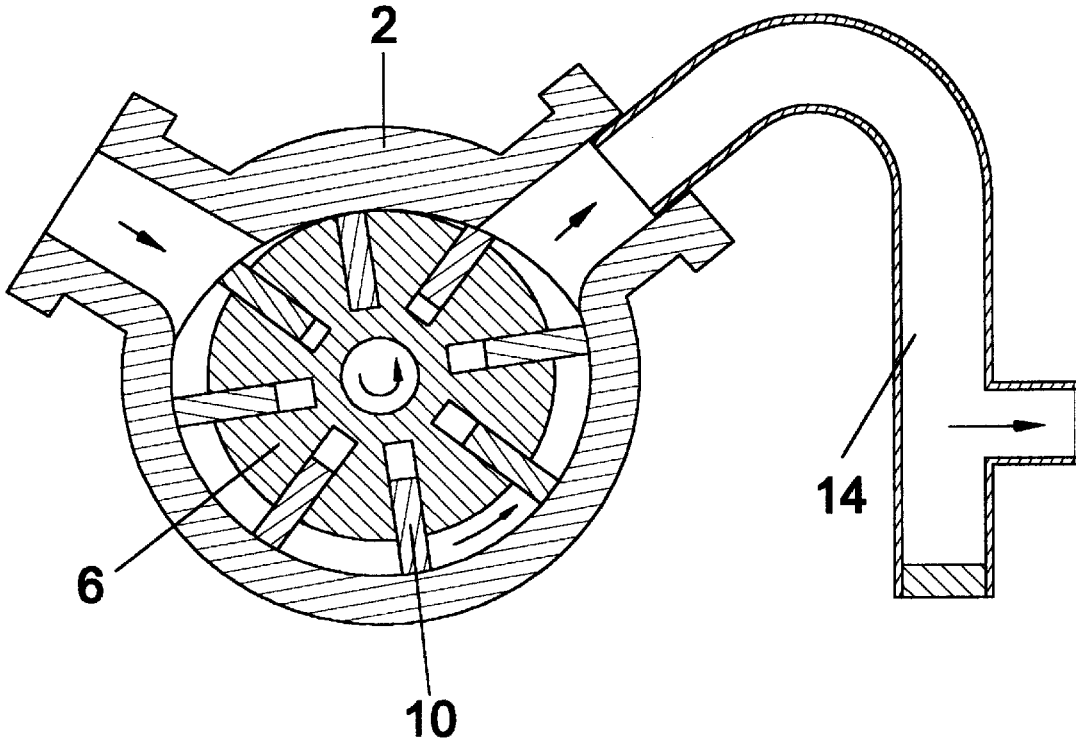
FIG. 1 shows a lateral cross section of a typical sliding vane pump.
Figure 2:
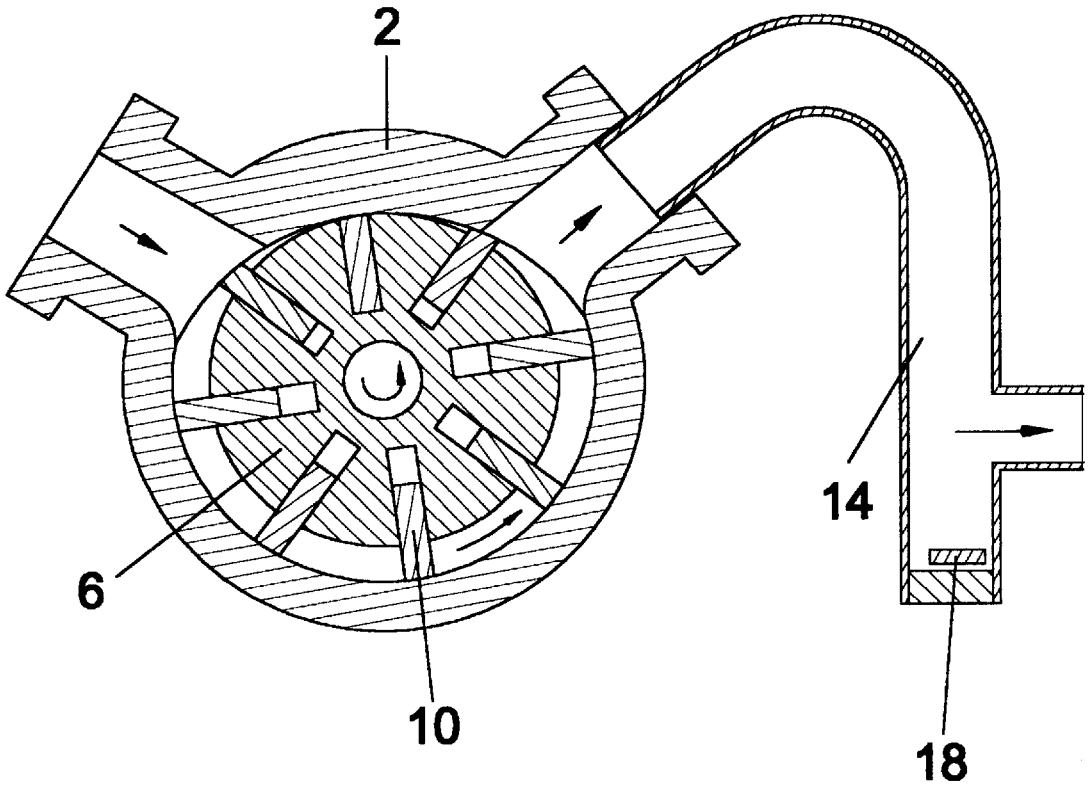
FIG. 2 shows a magnet suspended in the discharge conduit.
Figure 3:
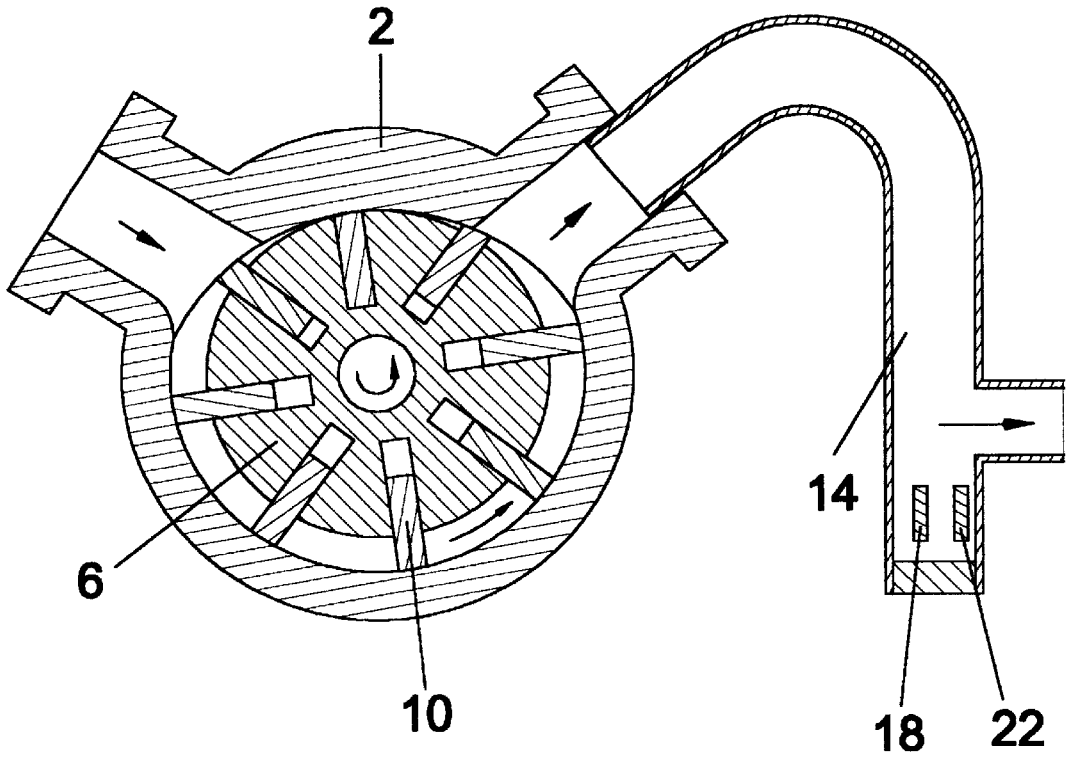
FIG. 3 shows a magnet and collocated switch contact in the discharge conduit.
Figure 4:
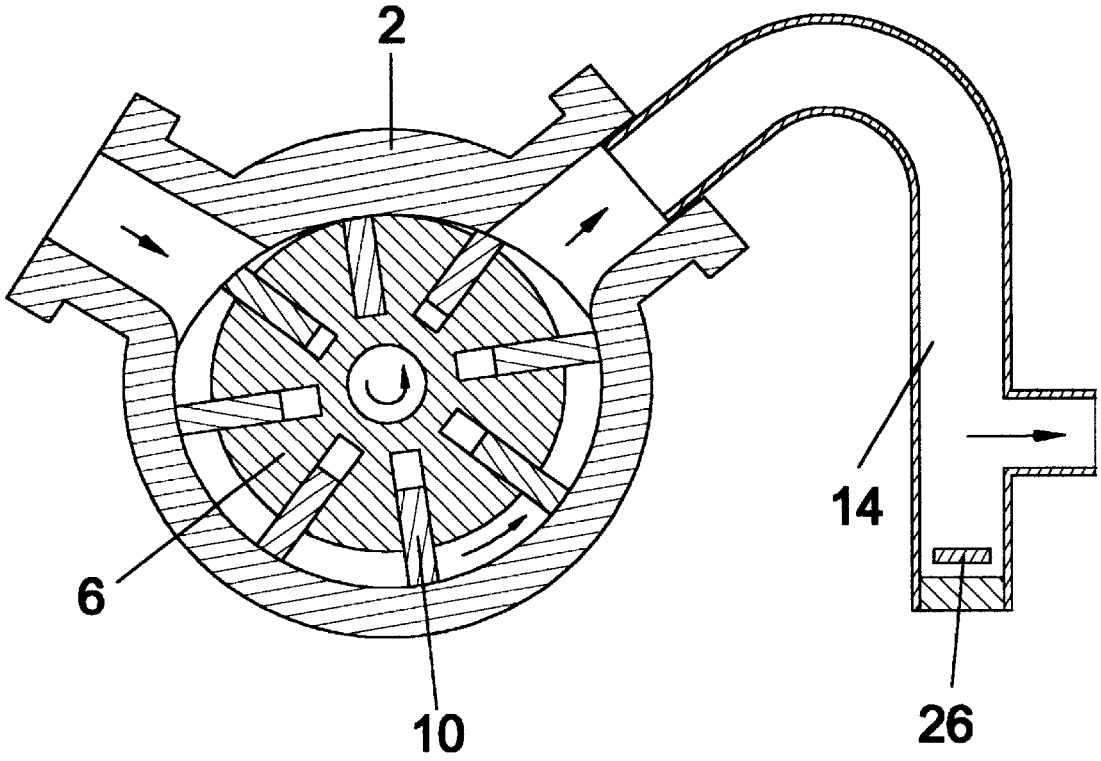
FIG. 4 shows litmus paper suspended in the discharge conduit.
Figure 5:
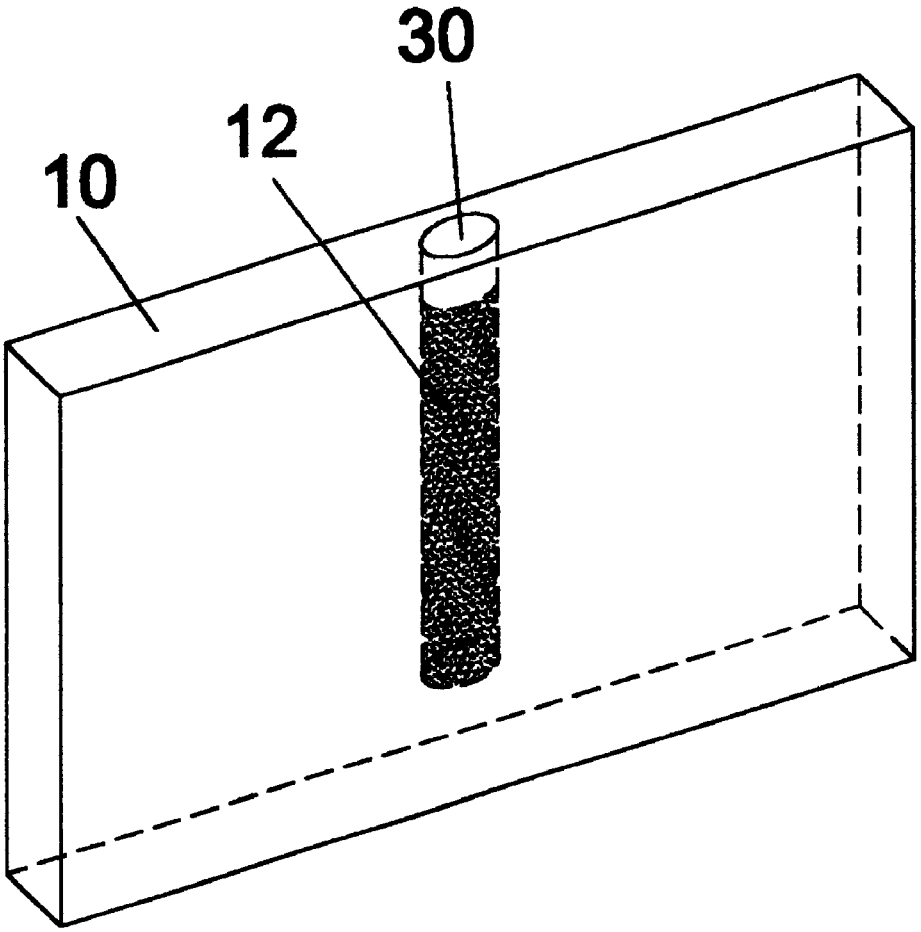
FIG. 5 shows a vane with cavity for encapsulation of tracer material.

| | |
|---|---|
| 2 | housing |
| 6 | rotor |
| 10 | vane |
| 14 | discharge conduit |
| 18 | magnet |
| 22 | switch contact |
| 26 | litmus paper |
| 30 | cavity seal |

DETAILED DESCRIPTION OF THE INVENTION

FIGS. 1 & 5

The vanes 10 of rotary sliding vane pumps are held in contact with the pump housing 2 by centrifugal force plus, in some cases, spring force. The applied force enhances the sealing effect between the working edge of the vanes and the pump housing. The resulting friction abrades the working edge of the vanes even though they are usually made of low friction or self-lubricating material, typically graphite. The concept of the automatic wear indicator is to place encapsulated tracer material 12 within the vanes of the pump at a location such that the cavity in which it is contained, is worn into and opened when the vane reaches a predetermined length. The predetermined length represents the minimum vane length required for continued reliable operation of the pump. When the cavity is opened, the tracer material is expelled into the pumping chamber by centrifugal force and is swept out of the pump and into the discharge conduit by the air/gas flow. The chromatic properties of the tracer material make its presence in the discharge conduit easily detected. Since the vanes are typically manufactured by molding, the cavity can be economically molded into the vane during the manufacturing process. The cavity is closed by use of a seal 30. A section of the discharge conduit can be made of transparent material to enhance visibility. Laboratory testing has shown that the strength of the vane is not critically diminished by the presence of a cavity whose volume is large enough to contain a sufficient quantity of tracer material. The testing also shows that decorative material, commonly referred to as glitter or sparkle, serves well as tracer material. While the preferred tracer material is one whose single color is its distinctive property, multi-color material would be an alternative. Other alternative materials include those materials which exhibit a readily discernible, distinctive property as follows: chemical, magnetic, electromagnetic, electrostatic, electrically conductive, luminescent, odorous, reflective, physical, radio frequency response, optical.

FIGS. 2, 3, 5

Magnetic tracer material collected on a magnet 18 within the discharge conduit 14, along with a collocated switch contact 22 oriented such that the captured conductive material completes an electrical circuit to turn on an annunciator. The annunciator can be located on the instrument panel of an aircraft and serve as an in-flight indication that the pump has reached the predetermined wear limit. The annunciator can signal visually and aurally. In addition or separately, the switch can be made to turn on auxiliary or backup systems. Alternatively, and less complicated, a magnet suspended inside of the discharge conduit can be used to simply capture the tracer material and thereby present a visual signal, by the accumulation of material on its surface, that the vanes have reached their predetermined wear limit.

FIGS. 4, 5

Presence of acidic or alkaline tracer material in the discharge conduit can be detected by using litmus paper 26 or other means of detecting acid/alkaline properties.

The wear indicator of this invention can be used to automatically warn of eminent failure of critical pumping systems. The wear indicator has additional advantages in that:

a) it provides for use of a variety of tracer materials b) it requires no internal visual inspections c) it provides a means to automatically switch on an annunciator, backup equipment and auxiliary equipment d) it provides a simple indicator which requires no special technical skills for interpretation e) it is accurate f) its function is independent of the individual vane's wear rate Although the description above contains many specificities, these should not be construed as limiting the scope of the invention but as mere illustrations of the presently preferred embodiments of this invention. For example, the vanes can have more than one cavity, each containing a different tracer material. The cavities can be oriented in different directions and interconnected. Depths of multiple cavities could vary to yield multiple releases of similar or dissimilar tracer material. Different vanes of the same pump can have differently shaped cavities.

This vane wear indicator can also be used in many industrial applications besides aircraft usage.

Thus the scope of the invention should be determined by the appended claims and their legal equivalents, rather than the examples given.

What I claim as my invention is:

1. An automatic wear indicator for sliding vane pumps which incorporates tracer material encapsulated within or otherwise attached to the vanes of said pump in such a manner that it is released into the external discharge conduit of the pump when the vanes have reached a predetermined wear condition.

2. The pump of claim 1 wherein said automatic wear indicator includes pigmented tracer material encapsulated within or otherwise attached to the vanes in a manner such that it is released into the external discharge conduit of the pump when the vanes have reached a predetermined wear condition, where the presence is visually detected by its color.

3. The pump of claim 1 wherein said automatic wear indicator includes chemically reactive tracer material encapsulated within or otherwise attached to the vanes in a manner such that it is released into the external discharge conduit of the pump when the vanes have reached a predetermined wear condition, where the presence is visually detected, by the use of litmus paper or other alkaline/acid detection means.

4. The pump of claim 1 wherein said automatic wear indicator includes luminescent tracer material encapsulated within or otherwise attached to the vanes in a maimer such that it is released into the external discharge conduit of the pump when the vanes have reached a predetermined wear condition, where the presence is visually detected by the use of ultra-violet, black light or other luminescence activation device.

5. The pump of claim 1 wherein said automatic wear indicator includes radio frequency excitable tracer material encapsulated within or otherwise attached to the vanes in a manner such that it is released into the external discharge conduit of the pump when the vanes have reached a predetermined wear condition, where the presence is visually detected by use of a radio frequency excitation source.

6. The pump of claim 1 wherein said automatic wear indicator includes reflective tracer material commonly referred to as decorative glitter or other sparkling matter, encapsulated within or otherwise attached to the vanes in a maimer such that it is released into the external discharge conduit of the pump when the varies have reached a predetermined wear condition, where the presence is visually detected by illumination with a light source.

7. The pump of claim 1 wherein said automatic wear indicator includes odorous tracer material encapsulated within or otherwise attached to the vanes in a manner such that it is released into the external discharge conduit of the pump when the vanes have reached a predetermined wear condition, where its presence is detected by a distinct odor.

8. The pump of claim 1 wherein said automatic wear indicator includes magnetic tracer material encapsulated within or otherwise attached to the vanes in a manner such that it is released into the external discharge conduit of the pump when the vanes have reached a predetermined wear condition, where the presence is visually detected by the capture on a magnet(s) or other magnetic material collection device.

9. The pump of claim 1 wherein said automatic wear indicator includes magnetic tracer material encapsulated within or otherwise attached to the vanes in a manner such that it is released into the external discharge conduit of the pump when the vanes have reached a predetermined wear condition, and is captured in such a manner that the electrical conductivity acts as an electrical switch.

10. The pump of claim 1 wherein said automatic wear indicator includes magnetic tracer material encapsulated within or otherwise attached to the vanes in a manner such that it is released into the external discharge conduit of the pump when the vanes have reached a predetermined wear condition, and is captured in a manner such that the electrical conductivity acts as an electrical switch to turn on an annunciator located where it is detected by the equipment operator.

11. The pump of claim 1 wherein said automatic wear indicator includes magnetic tracer material encapsulated within or otherwise attached to the vanes in a maimer such that it is released into the external discharge conduit of the pump when the vanes have reached a predetermined wear condition, and is captured in a manner such that the electrical conductivity acts as an electrical switch to turn on auxiliary or standby equipment.

* * * * *